US006351087B1

(12) United States Patent
Katase et al.

(10) Patent No.: US 6,351,087 B1
(45) Date of Patent: Feb. 26, 2002

(54) MICROWAVE ELECTRODELESS DISCHARGE LAMP APPARATUS

(75) Inventors: Koichi Katase, Osaka; Tsuyoshi Ichibakase, Takatsuki; Katsushi Seki, Shiga, all of (JP)

(73) Assignee: Matsushita Electronics Corporation, Takatsuki (JP)

( * ) Notice: Subject to any disclaimer, the term of this patent is extended or adjusted under 35 U.S.C. 154(b) by 0 days.

(21) Appl. No.: 09/347,755

(22) Filed: Jul. 6, 1999

(30) Foreign Application Priority Data

Jul. 15, 1998 (JP) ..... 10-199990

(51) Int. Cl.[7] ..... H01J 23/00
(52) U.S. Cl. ..... 315/500; 315/344; 315/39
(58) Field of Search ..... 315/500, 39, 248, 315/267, 344

(56) References Cited

U.S. PATENT DOCUMENTS 5,216,322 A * 6/1993 Fuchs ..... 313/484
5,811,936 A * 9/1998 Turner et al. ..... 315/39
5,838,108 A * 11/1998 Frank et al. ..... 315/39
5,977,712 A * 11/1999 Simpson ..... 315/248
6,046,545 A * 4/2000 Horiuchi et al. ..... 315/39

FOREIGN PATENT DOCUMENTS

EP 0 035 898 A1 9/1981
JP 05159875 A 6/1993

* cited by examiner

*Primary Examiner*—Don Wong
*Assistant Examiner*—Thuy Vinh Tran
(74) *Attorney, Agent, or Firm*—Rosenthal & Osha L.L.P.

(57) ABSTRACT

A long life microwave electrodeless discharge lamp apparatus capable of preventing the generation of noise. The microwave electrodeless discharge lamp apparatus includes a magnetron having a magnetron tube and a yoke that surrounds the magnetron tube, a container housing at least the magnetron tube, a waveguide in which microwaves oscillated by the magnetron are propagated, an electrodeless discharge tube sealing luminescent materials excited by the microwaves to emit light, wherein a space surrounded by the yoke is communicated with the inside of the container, and wherein a fluid is sealed in the container. Thus, the magnetron tube is in a state in which it is immersed in the fluid.

8 Claims, 5 Drawing Sheets

MICROWAVE ELECTRODELESS DISCHARGE LAMP APPARATUS

FIELD OF THE INVENTION

The present invention relates to a microwave electrodeless discharge lamp apparatus in which microwaves oscillated by a magnetron excite luminescent materials to lead to discharge emission.

BACKGROUND OF THE INVENTION

Hitherto, this type of microwave electrodeless discharge lamp apparatus is disclosed in, for example, a publication of JP56-126250 A.

Namely, as shown in FIG. 5, a conventional apparatus includes a magnetron 14 generating microwaves, a cylindrical hollow container 2 made of metal mesh materials that cannot transmit microwaves but can transmit a light, a waveguide 15 propagating the generated microwaves to the hollow container 2, a container 16 housing the magnetron 14 and the hollow container 2.

The magnetron 14 is provided with an antenna 10 oscillating microwaves, a magnetron tube 17 substantially generating microwaves, a yoke 9 forming a magnetic path in such a manner that surrounds the magnetron tube 17 and a radiation fin 18 radiating heat that was generated at the magnetron tube 17. The hollow container 2 includes an electrodeless discharge tube 5 that is supported and fixed by a supporting stick 4 made of silica glass and that is filled with luminescent materials. On a part of the wall of the container 16, a cooling fan 19 is provided so as to cool the magnetron 14.

Next, an operation of such a conventional microwave electrodeless discharge lamp apparatus will be explained.

Microwaves generated at the magnetron tube 17 are oscillated from the antenna 10 into the waveguide 15, propagated inside the waveguide 15 and fed into the hollow container 2 by way of a feeding hole 11 of the waveguide 15. The fed microwaves excite the luminescent materials sealed in the electrodeless discharge tube 5 to lead to discharge emission. When the magnetron 14 generates the microwaves, heat loss occurs in the magnetron tube 17, thus raising the temperature of the magnetron tube 17. As a result, an unstable operation or short lifetime of the magnetron 14 is caused. Therefore, in order to control the temperature of the magnetron tube 17 to such a temperature that does not affect the practical use of the application, the cooling fan 19 is operated to feed cooled air into the yoke 9 at about 1000 liter/min. Thus, a forced cooling of the magnetron tube 17 is carried out. Thereafter, the cooled air flows out from the apparatus by way of a ventilating hole 20, the feeding hole 11 and the container 2.

However, since such a conventional microwave electrodeless discharge lamp apparatus uses a forced cooling system using a fan, the apparatus is susceptible to the influence of the operation environment. There was a problem in that, for example, suction or accumulation of dust, dirt, insect, etc. by the apparatus may cause the deterioration of the magnetron tube or the cooling fan, etc. Consequently, the long lifetime of the apparatus cannot be realized.

Furthermore, there was another problem in that great noise occurs due to the rotation of the fan and air stream.

SUMMARY OF THE INVENTION

It is therefore an object of the present invention to provide a long lifetime microwave electrodeless discharge lamp apparatus capable of inhibiting the generation of noise.

In order to achieve the above-mentioned object, the microwave electrodeless discharge lamp apparatus of the present invention includes a magnetron having a magnetron tube and a yoke that surrounds the magnetron tube, a container housing at least the magnetron tube, a propagation path in which microwaves oscillated by the magnetron are propagated, an electrodeless discharge tube sealing luminescent materials excited by the microwaves to emit light, wherein a space defined by the yoke is communicated with the inside of the container, and wherein a fluid is sealed in the container.

According to such a microwave electrodeless discharge lamp apparatus, heat generated in the magnetron tube is conducted in the fluid and the container and then radiated outside. Thus, the magnetron tube can stably be operated. Furthermore, the magnetron, etc. can be protected from the contamination of foreign substances causing the deterioration of the magnetron tube, etc. In addition, since the fluid circulation uses the thermal convection, a cooling of the magnetron tube can quietly be carried out.

It is preferable in the above-mentioned microwave electrodeless discharge lamp apparatus that the container is formed of good thermal conductors. With such a microwave electrodeless discharge lamp apparatus, heat of the fluids are easily radiated to the outside via the container.

Furthermore, it is preferable that the container is provided with a circulation path in which the fluid circulates.

Furthermore, it is preferable that the circulation path is formed by making the container a double wall structure. With such a microwave electrodeless discharge lamp apparatus, since the surface area of the container can be increased, the amount of the radiated heat from the fluid is increased, thus enabling the cooling efficiency of the magnetron tube to be improved.

Furthermore, it is preferable that the container is provided with a radiator radiating heat from the fluid. With such a microwave electrodeless discharge lamp apparatus, the amount of the radiated heat from the fluid is increased, thus further improving the cooling efficiency of the magnetron tube. Furthermore, the amount of fluid to be sealed can be reduced, which can lead to cost reduction, miniaturization and weight reduction of the apparatus.

Furthermore, it is preferable that the radiator is a conduit provided with a large number of radiation boards on its outer surface.

Furthermore, it is preferable that the radiator is formed of a plurality of thin conduits arranged in parallel. With such a microwave electrodeless discharge lamp apparatus, since the surface area of the container can be increased, the amount of the radiated heat from the fluid can be increased.

Furthermore, it is preferable that the fluid is insulating oil. Such a microwave electrodeless discharge lamp apparatus have excellent electric insulating property, fluidity, cold fluidity and metallic corrosion behavior or the like.

DETAILED DESCRIPTION OF THE INVENTION

Hereinafter, the present invention will be described with reference to the drawings.

Figure 1:
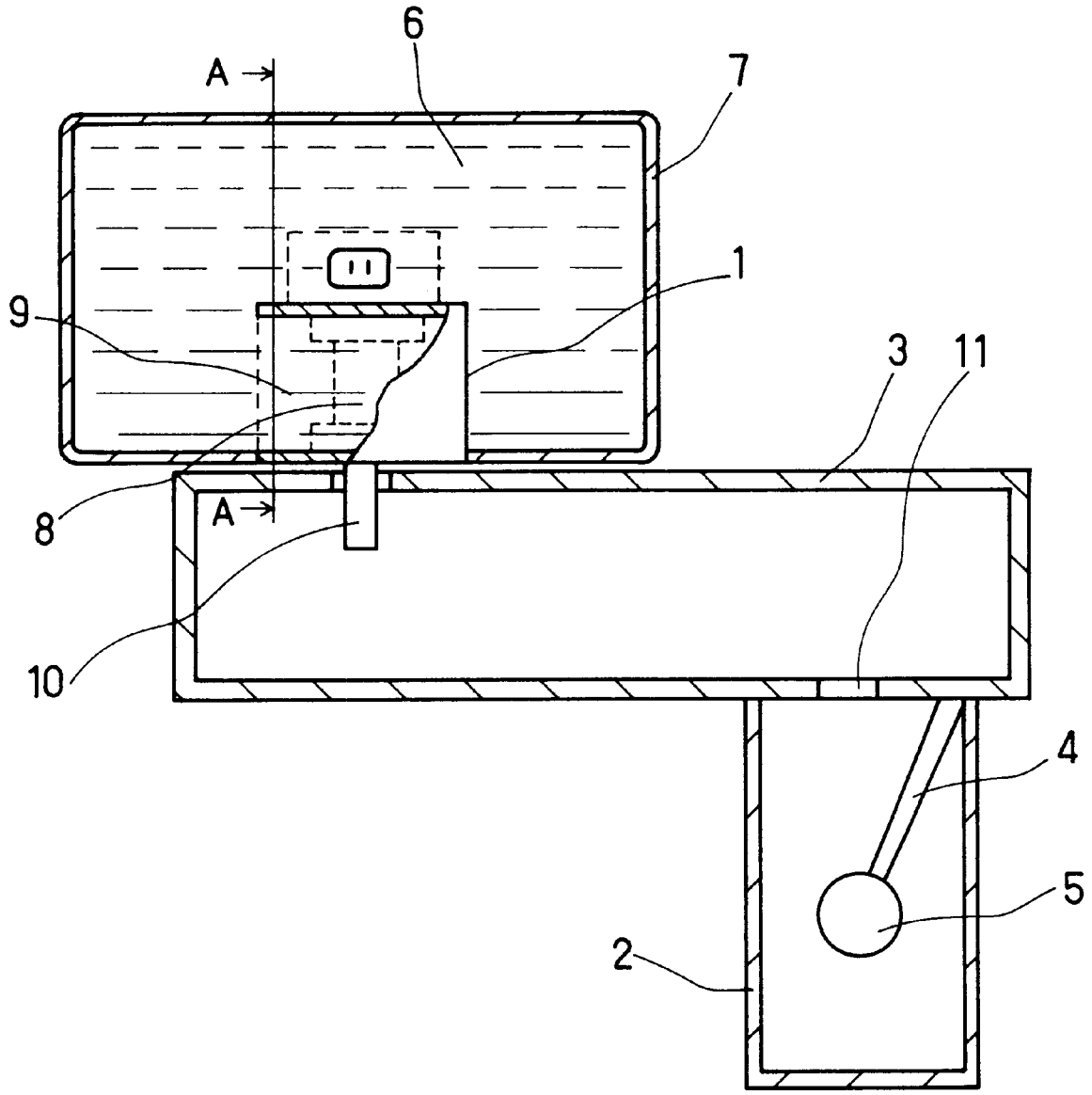
FIG. 1 is a cut away, elevation view of a microwave electrodeless discharge lamp apparatus according to a first embodiment of the present invention.

As shown in FIG. 1, the microwave electrodeless lamp apparatus of the first embodiment of the present invention includes a magnetron 1 generating microwaves, a cylindrical hollow container 2 made of a conductive mesh material that cannot transmit microwaves but can transmit light, a waveguide 3 in which the microwaves generated by the magnetron 1 are propagated to the hollow container 2, an electrodeless discharge tube 5 that is supported by a supporting stick 4 made of dielectric materials, etc., and that is housed in the hollow container 2, and a container 7, which is made of copper, aluminum, etc., tightly sealing a cooling fluid 6 including, e.g. insulation oil etc.

Figure 2:
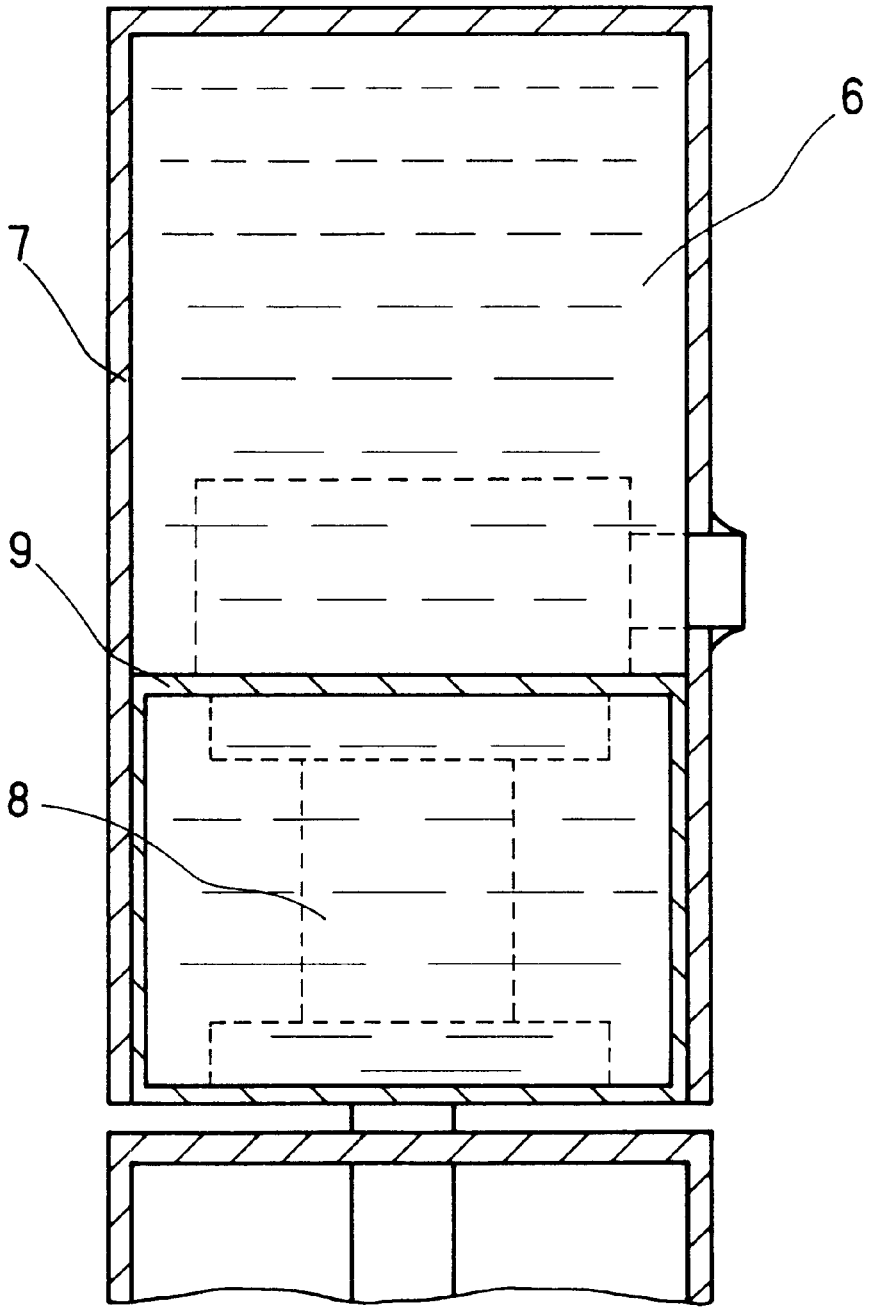
FIG. 2 is a cross-sectional view taken in line A—A of FIG. 1.

The magnetron 1 is provided with a magnetron tube 8 substantially generating microwaves, a yoke 9 forming a magnetic path in such a manner that surrounds the magnetron tube 8 and an antenna 10 oscillating microwaves to the waveguide 3. As also shown in FIG. 2 (a cross-sectional view taken in line A—A of FIG. 1), a space defined by the yoke 9 is connected to the inside of the container 7 and communicated therewith. Therefore, the magnetron tube 8 provided in the space surrounded by the yoke 9 is immersed in the fluid 6.

The hollow container 2 is electrically connected to the waveguide 3 so that microwaves do not leak out, and is communicated with the inside of the waveguide 3 via a feeding hole 11.

The electrodeless discharge tube 5 is made of transparent silica glass or translucent ceramic etc., and is sealed with a metal halide such as InBr, etc., as the luminescent material and with an inert gas such as Ar.

Moreover, in order to obtain a stable and uniform discharge emission, the electrodeless discharge tube 5 may be lighted up by using the supporting stick 4 to which a motor, etc. (not shown), is connected as a rotation axis.

Next, the operation of the microwave electrodeless discharge lamp apparatus of the above-mentioned embodiment will be explained.

The microwaves oscillated from the antenna 10 are propagated in the waveguide 3 and fed to the hollow container 2 by way of the feeding hole 11. The fed microwaves excite the luminescent materials filled in the electrodeless discharge tube 5, thus leading to discharge emission of the electrodeless discharge tube 5.

With such an oscillation operation of microwaves, the temperature of the magnetron tube 8 is increased, thus raising the temperature of the fluid 6 in the periphery of the magnetron tube 8. As a result, the difference between the temperature of the fluid 6 in the periphery of the magnetron tube 8 and that of the most distant place from the magnetron tube 8 is increased, thus causing the thermal convection of the fluid 6 in the container 7. Therefore, the fluid 6 circulates in the container 7. While the fluid 6 circulates, the heat of the fluid 6 is radiated outside via the container 7 because the container 7 has a good thermal conductivity. As a result, the temperature of the fluid in the periphery of the magnetron tube 8 can considerably be reduced. Namely, the temperature of the magnetron 8 can sufficiently be reduced to the temperature required to obtain a stable operation of the magnetron 1.

In the above-mentioned embodiment, the waveguide 3 was used as a propagation path for microwaves, however, a coaxial line may be used. In this case, however, an antenna, etc., is used in place of the feeding hole 11.

Furthermore, in the above-mentioned embodiment, the insulating oil was used for the fluid 6. As the fluid 6, for example, materials that are excellent in electrically insulating property, fluidity, cold fluidity, metallic corrosion behavior, or the like are preferably used. However, besides the above, cheap water, air such as helium, etc., in which the pressure is adjusted to have a moderated thermal conductivity, and a fluid such as freon gas, etc., using the exothermic/endothermic reaction by the phase change between liquid and air.

Furthermore, the waveguide 3 or the container 7 etc. may be housed in a frame (not shown). In this case, the waveguide 3 or container 7, etc., is closely bonded to the frame at least in part, or a thermal conductive product, etc., is intervened between at least one part of the waveguide 3 or container 7 and the frame so that the waveguide 3 or the container 7, etc., and the frame are thermally bonded to each other. Thus, the above-mentioned cooling effect with respect to the magnetron tube 8 can be maintained.

According to the structure of the first embodiment, the magnetron 8 can efficiently be cooled so as to obtain a stable operation. Furthermore, the magnetron 8, etc., can be protected from the contamination of foreign substances causing the deterioration of the magnetron tube 8, etc. Thus, the deterioration of the magnetron 8, etc., can be prevented, and in turn a long lifetime of the microwave electrodeless discharge lamp apparatus can be realized. In addition, because the circulation of the fluid 6 uses the thermal convection without using a circulation device such as a pump etc., the generation of noise can be prevented. Furthermore, since the entire magnetron tube is immersed in the fluid 6, the cooling efficiency is much better than that of the conventional forced cooling. Therefore, the radiation fin that was used in the conventional magnetron having the forced cooling can be omitted, thus simplifying the structure of the apparatus.

Figure 3:
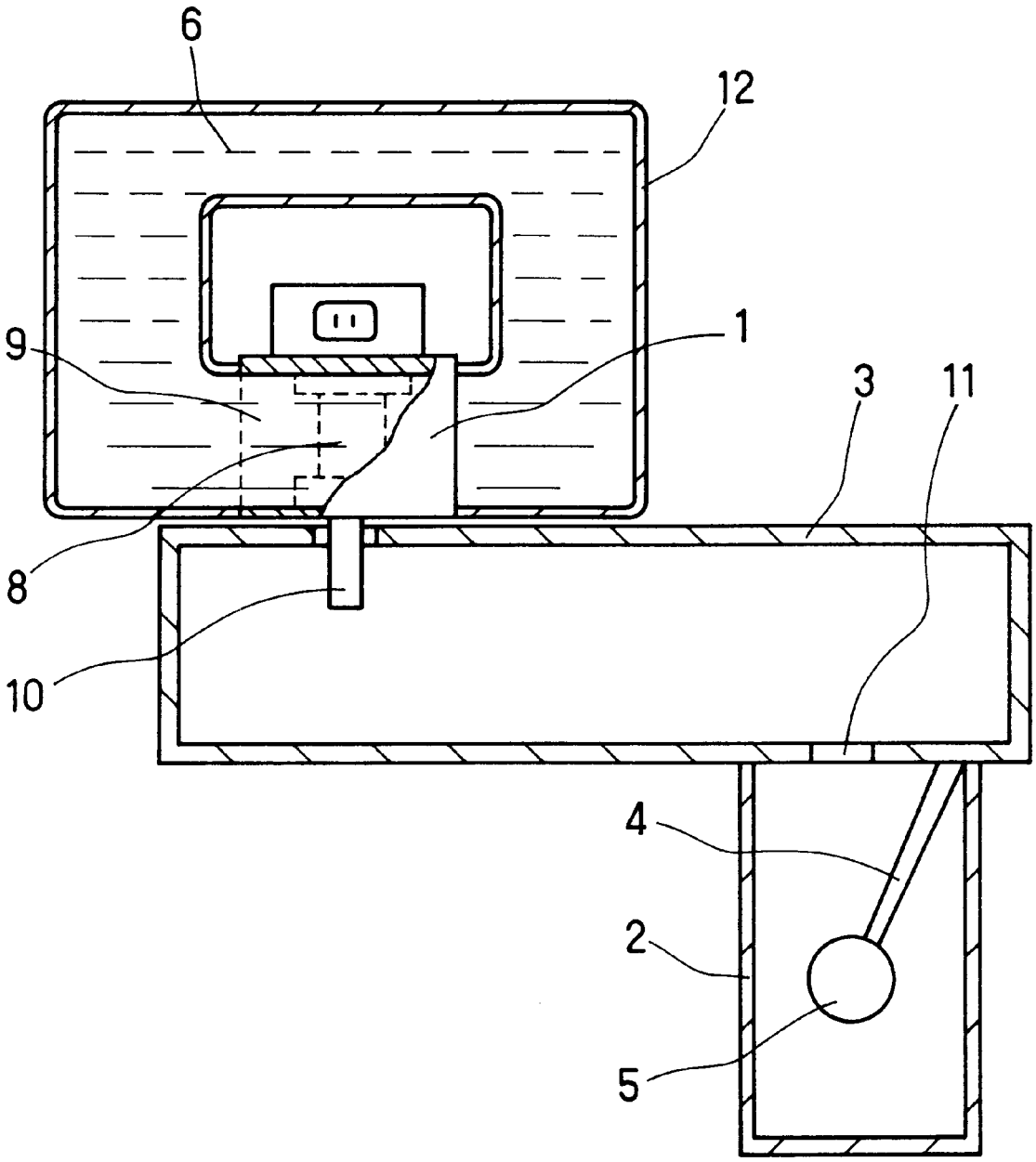
FIG. 3 is a cut away, elevation view of a microwave electrodeless discharge lamp apparatus according to a second embodiment of the present invention.

Next, as shown in FIG. 3, the structure of the microwave electrodeless discharge lamp apparatus of the second embodiment of the present invention is the same as that shown in FIG. 1 except that the container 12 has a double wall forming a circulation path, the fluid 6 is sealed in the circulation path and the magnetron tube 8 and the yoke 9 are provided in the circulation path of the container 12. In FIG. 3, since the components given the same reference numbers as in FIG. 1 have the same functions as FIG. 1, the explanations of such components are omitted herein.

According to the structure of the second embodiment, when the fluid 6 circulates in the circulation path in the container 12, since the surface area of the container 12 is larger than that of the container 7, the amount of the radiated heat from the fluid 6 is increased, thus enabling the cooling efficiency of the magnetron tube 8 to be improved.

Figure 4:
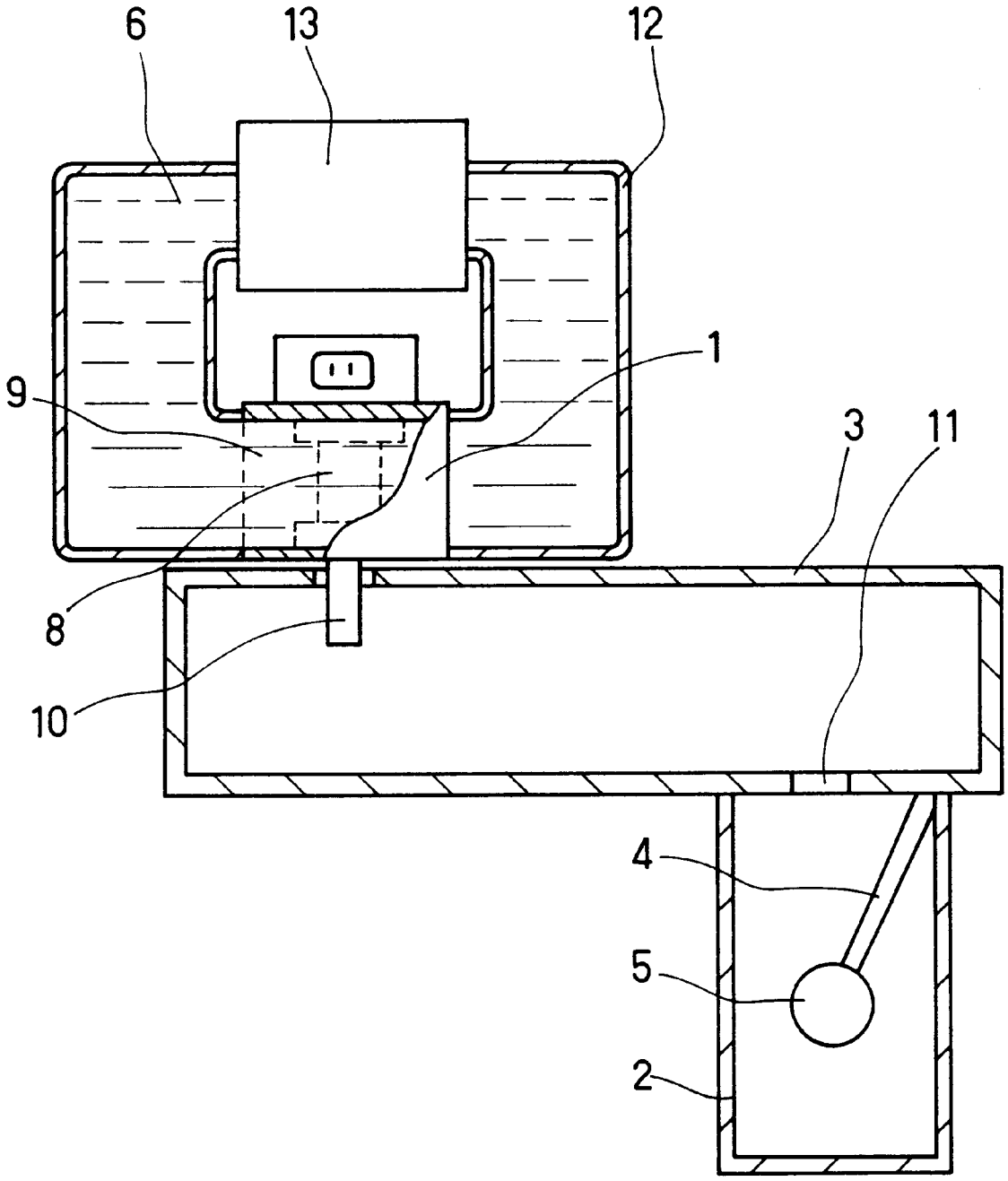
FIG. 4 is a cut away, elevation view of a microwave electrodeless discharge lamp apparatus according to a third embodiment of the present invention.
Figure 5:
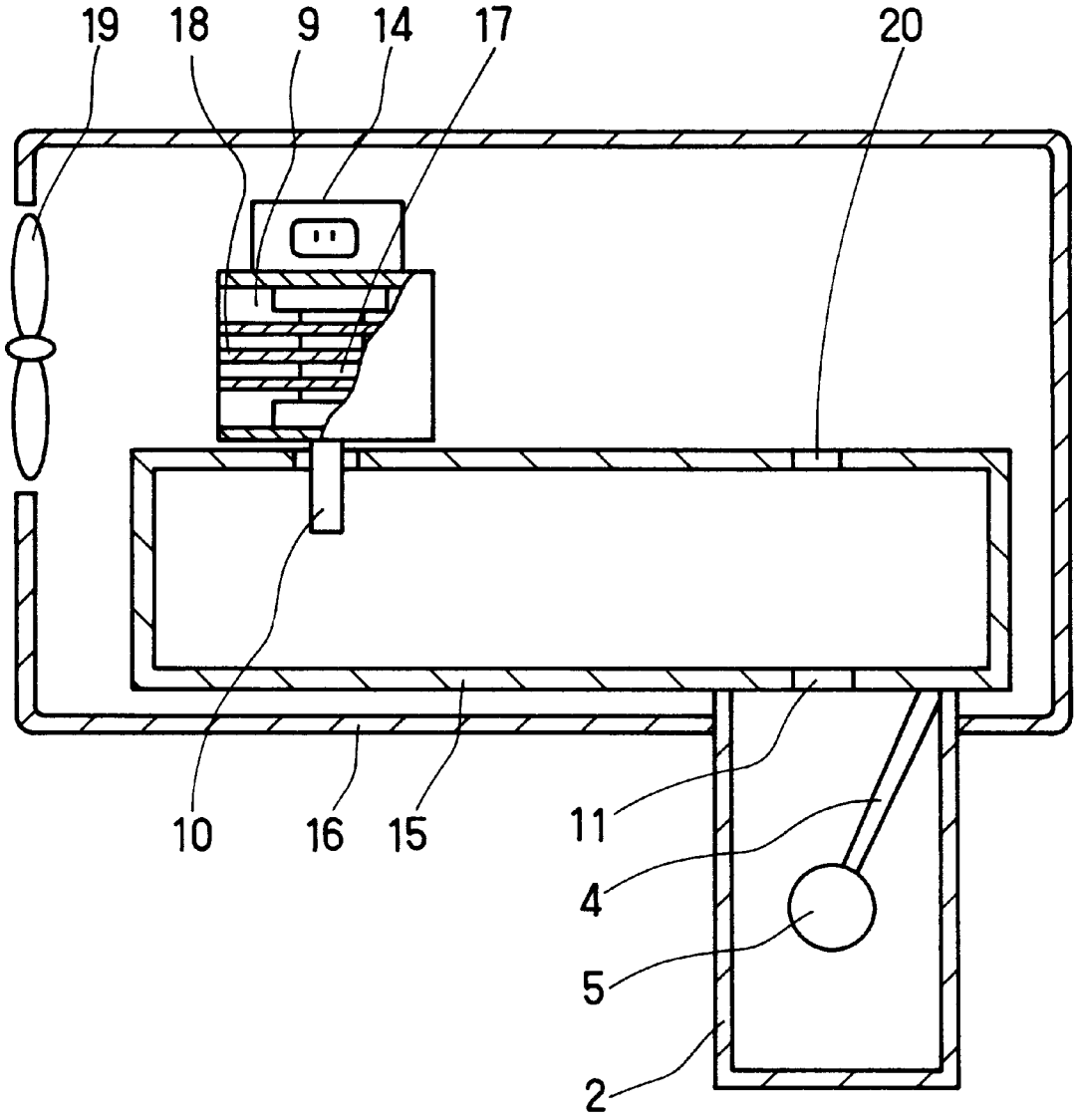
FIG. 5 PRIOR ART
FIG. 5 is a cut away, elevation view of a microwave electrodeless discharge lamp apparatus according to the prior art.

Furthermore, as shown in FIG. 4, the structure of the microwave electrodeless discharge lamp apparatus of the third embodiment of the present invention is the same structure as that shown in FIG. 3 except that a radiator 13 is provided in the circulation path of the container 12. Examples of the materials for the radiator 13 include aluminum, copper, etc. In FIG. 4, since the components given the same reference numbers as in FIG. 3 have the same functions as FIG. 3, the explanations of such components are omitted herein. The radiator 13 is formed of a component whose surface area is made to be large so as to increase the amount of the radiated heat, for example, a conduit on which a large number of radiation boards (not shown) are arranged on its outer surface, or a component on which a plurality of thin conduits like organic capillaries (not shown) are arranged in parallel, or the like.

According to the structure of the third embodiment of the present invention, the amount of the heat from the fluid 6 radiated by the radiator 13 is increased, thus enabling the cooling efficiency of the magnetron tube 8 to be further improved. Furthermore, since the amount of the fluid 6 to be sealed can be reduced while the fluid 6 still covers the magnetron tube, the cost reduction and miniaturizing or lightening of the microwave electrodeless discharge lamp apparatus can be realized.

In addition, when the radiator 13 is used for the container 7 of the first embodiment, the same effect can be obtained.

The invention may be embodied in other specific forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A microwave electrodeless lamp apparatus comprising a magnetron having a magnetron tube and a yoke that surrounds said magnetron tube, a container housing at least said magnetron tube, a propagation path in which microwaves oscillated by said magnetron are propagated, an electrodeless discharge tube sealing luminescent materials excited by said microwaves to emit light, wherein a space defined by said yoke is in communication with an inside of said container, and wherein a fluid is sealed in said container.

2. The microwave electrodeless discharge lamp apparatus according to claim 1, wherein said container is formed of thermal conductors.

3. The microwave electrodeless discharge lamp apparatus according to claim 1, wherein said container is provided with a circulation path in which said fluid circulates.

4. The microwave electrodeless discharge lamp apparatus according to claim 3, wherein said circulation path is formed by making said container a double wall structure.

5. The microwave electrodeless discharge lamp apparatus according to claim 1, wherein said fluid is insulating oil.

6. A microwave electrodeless lamp apparatus comprising a magnetron having a magnetron tube and a yoke that surrounds said magnetron tube, a container housing at least said magnetron tube, a propagation path in which microwaves oscillated by said magnetron are propagated, an electrodeless discharge tube sealing luminescent materials excited by said microwaves to emit light, wherein a space defined by said yoke is in communication with an inside of said container, wherein a fluid is sealed in said container, and wherein said container is provided with a radiator radiating heat from the fluid.

7. The microwave electrodeless discharge lamp apparatus according to claim 6, wherein said radiator is a conduit provided with a large number of radiation boards on its outer surface.

8. The microwave electrodeless discharge lamp apparatus according to claim 6, wherein said radiator is formed of a plurality of thin conduits arranged in parallel.

* * * * *